US005572304A

United States Patent [19]

Seto et al.

[11] Patent Number: 5,572,304

[45] Date of Patent: Nov. 5, 1996

[54] INTERMEDIATE IMAGE TRANSFER ELEMENT AND IMAGE FORMING APPARATUS USING THE SAME

[75] Inventors: Mitsuru Seto, Yamakita-machi; Yasuo Hirano, Numazu, both of Japan

[73] Assignee: Ricoh Company, Ltd., Tokyo, Japan

[21] Appl. No.: 377,340

[22] Filed: Jan. 24, 1995

[30] Foreign Application Priority Data

| | | | |
|---|---|---|---|
| Jan. 24, 1994 | [JP] | Japan | 6-023396 |
| Jan. 24, 1994 | [JP] | Japan | 6-023397 |
| Jan. 14, 1995 | [JP] | Japan | 7-021153 |

[51] Int. Cl.[6] ..... G03G 15/14; G03G 15/16

[52] U.S. Cl. ..... 399/313; 430/124; 430/126; 399/314; 399/318

[58] Field of Search ..... 355/271–277; 430/126, 124; 428/98, 158, 159, 172, 492, 493

[56] References Cited

U.S. PATENT DOCUMENTS

| | | | |
|---|---|---|---|
| 4,411,977 | 10/1983 | Tarumi et al. | 430/126 |
| 4,588,279 | 5/1986 | Fukuchi et al. | 355/271 |
| 4,984,026 | 1/1991 | Nishise et al. | 355/271 X |
| 5,027,159 | 6/1991 | Oda et al. | 355/271 |
| 5,099,286 | 3/1992 | Nishise et al. | 355/272 |
| 5,138,363 | 8/1992 | Yuge | 355/275 X |
| 5,189,478 | 2/1993 | Hara et al. | 355/271 |
| 5,208,638 | 5/1993 | Bujese et al. | 355/274 |
| 5,243,392 | 9/1993 | Berkes et al. | 355/275 |
| 5,298,956 | 3/1994 | Mammino et al. | 355/275 |
| 5,409,557 | 4/1995 | Mammino et al. | 430/126 X |

FOREIGN PATENT DOCUMENTS

| | | |
|---|---|---|
| 57-8569 | 1/1982 | Japan . |
| 3-7966 | 1/1991 | Japan . |
| 3-69166 | 7/1991 | Japan . |
| 3-192282 | 8/1991 | Japan . |
| 4-325556 | 11/1992 | Japan . |
| 4-318578 | 11/1992 | Japan . |

*Primary Examiner*—Matthew S. Smith

*Attorney, Agent, or Firm*—Oblon, Spivak, McClelland, Maier & Neustadt, P.C.

[57] ABSTRACT

An image forming apparatus capable of reducing the irregularity in the inside resistance of an intermediate image transfer belt thereof to insure uniform images, and reducing the change in the resistance of the belt due to aging to enhance image quality. The belt has a laminate structure including an upper or high resistance layer and a lower or support layer. The specific resistance of the belt is higher in the upper layer than in the lower layer. Optimally, the specific resistance of the upper layer ranges from $1\times10^{10}$ Ωcm to $1\times10^{16}$ Ωcm.

20 Claims, 3 Drawing Sheets

INTERMEDIATE IMAGE TRANSFER ELEMENT AND IMAGE FORMING APPARATUS USING THE SAME

BACKGROUND OF THE INVENTION

The present invention relates to a copier, facsimile apparatus, printer or similar electrophotographic image forming apparatus and, more particularly, to an image forming apparatus of the type having an intermediate image transfer element implemented as, for example, a belt for sequentially effecting primary and secondary image transfer steps.

Intermediate image transfer elements for image forming apparatuses of the type described may generally classified into two kinds, i.e., one made of a dielectric material either entirely or only at the surface thereof where toner is to deposit, and the other made of a material having a medium resistance. For the element having a medium resistance, specific surface resistances, materials and resistance control agents are taught in, for example, Japanese Patent Laid-Open Publication Nos. 63-311263, 56-164368, and 64-74571. The conventional elements are implemented as a seamless belt or a drum having a single layer.

The conventional intermediate image transfer element having a medium resistance has a problem that the inside resistance thereof is scattered by about one figure. This, coupled with the fact that the resistance of the element changes due to aging, lowers the quality of images. Another problem is that the element is apt to invite defective images images due to, for example, toner dust or transfer dust, compared to the element made of a dielectric material. Assume that the medium resistance of the element is implemented by dispersing carbon, metal oxide or similar resistance control agent, or filler, in base resin (mainly polycarbonate, polyvinylidene fluoride, ETFE (ethylene tetrafluoroethylene), polyimide or the like). Then, since the filler is dispersed in the base resin in a great amount, it deteriorates the surface of the belt and thereby brings about toner filming, change in the chargeability of toner, and degradation of images.

Generally, the irregularity in the inside resistance of such an image transfer element is attributable to a production line. The one-figure of irregularity is substantially considered to be the limit of state-of-the-art technologies. Regrading the uniformity of an image, the resistance of the element should preferably be uniform in order to avoid an irregular image attributable to irregular image transfer. Particularly, when the element is provided with a relatively high surface resistance of $10^9$ $\Omega/cm^2$ or above, the optimal primary transfer bias range for any belt resistance decreases. Hence, it is necessary to control the irregularity in resistance more strictly in order to insure uniform images. Stated another way, uniform images are not attainable when the irregularity amounts to about one figure.

The change in the resistance of the intermediate image transfer element due to aging depends on the material of the element and a resistance control agent. For example, when the major component of the element is an elastomer, the chain structure of an inorganic resistance control agent or similar filler dispersed in the elastomer breaks up due to aging, so that the resistance tends to increase. When the dispersibility of the filler in the material of the element is short, the filler is apt to cohere due to aging and due to a transfer electric field or similar electrical hazard, causing the resistance to decrease. The change in the resistance of the element due to aging has the following side effects. To begin with, the optimal bias for the primary transfer is deviated to lower image quality. Specifically, a change in resistance results in a change in optimal bias and thereby displaces the optimal bias range after the change in resistance from the initially set value. Another side effect is that the uniformity of an image is lowered due to the irregular change in the resistance due to aging. A further side effect is that blurred images and other defective images are produced (under a low resistance condition).

The intermediate image transfer element of medium resistance is inferior to the element made of a dielectric material in respect of transfer dust. This is because a driving force for toner transfer is implemented only by an electric field in the case of the dielectric element, but it is implemented by both of a transfer current and an electric field in the case of the medium resistance element. Therefore, while the dielectric element may be advantageous over the medium resistance element, transfer dust of a degree close to one available with the dielectric element is desired.

SUMMARY OF THE INVENTION

It is, therefore, an object of the present invention to provide an image forming apparatus capable of reducing the irregularity in the inside resistance of an intermediate image transfer element to insure uniform images, and reducing the change in the resistance of the element due to aging to enhance image quality and eliminate defective images.

It is another object of the present invention to provide an image forming apparatus capable of improving the degree of transfer dust to obviate defective images when use is made of an intermediate image transfer element of medium resistance, and reducing the change in the resistance of the element due to aging to enhance image quality and eliminate defective images.

It is a further object of the present invention to provide an intermediate image transfer element capable of preventing image quality from being lowered and free from filming on the surface thereof.

In accordance with the present invention, a movable endless intermediate image transfer element for an image forming apparatus and for transferring a visible image, transferred thereto from an image carrier by primary transfer, to a transfer medium by secondary transfer has an upper layer to which the visible image is to be transferred, and a lower layer positioned below the upper layer. The upper layer has a higher specific resistance than the lower layer.

Also, in accordance with the present invention, an image forming apparatus has an image carrier for forming a visible image thereon, a movable endless intermediate image transfer element for transferring the visible image, transferred thereto from the image carrier by primary transfer, to a transfer medium by secondary transfer. The intermediate image transfer element has an upper layer to which the visible image is to be transferred, and a lower layer positioned below the upper layer. The upper layer has a higher specific resistance than the lower layer.

Further, in accordance with the present invention, in a movable endless intermediate image transfer element for an image forming apparatus and for transferring a visible image, transferred thereto from an image carrier by primary transfer, to a transfer medium by secondary transfer, the intermediate image transfer element has a plurality of layers each consisting of a polymer component and a resistance control agent. The resistance control agent dispersed in the polymer component has a lower mean concentration in a surface layer than in the other layer.

Furthermore, in accordance with the present invention, an image forming apparatus has an image carrier for forming a visible image thereon, and a movable endless intermediate image transfer element for transferring the visible image, transferred thereto from the image carrier by primary transfer, to a transfer medium by secondary transfer. The intermediate image transfer element has a plurality of layers each consisting of a polymer component and a resistance control agent. The resistance control agent dispersed in the polymer component has a lower mean concentration in a surface layer, to which the visible image is to be transferred, than in the other layer.

Moreover, in accordance with the present invention, in a movable endless intermediate image transfer element for an image forming apparatus and for transferring a visible image, transferred thereto from an image carrier by primary transfer, to a transfer medium by secondary transfer, the element has a specific resistance of $1\times10^{8}$ Ωcm to $1\times10^{14}$ Ωcm and contains at least polyvinylidene fluoride and a polymer having a specific resistance of $1\times10^{12}$ Ωcm or below.

In addition, in accordance with the present invention, in an image forming apparatus for forming a visible image on an image carrier, transferring the visible image to a movable endless intermediate image transfer element by primary transfer, and then transferring the visible image to a transfer medium by secondary image transfer, the intermediate image transfer element has a specific resistance of $1\times10^{8}$ Ωcm to $1\times10^{14}$ Ωcm and contains at least polyvinylidene fluoride and a polymer having a specific resistance of $1\times10^{12}$ Ωcm or below.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
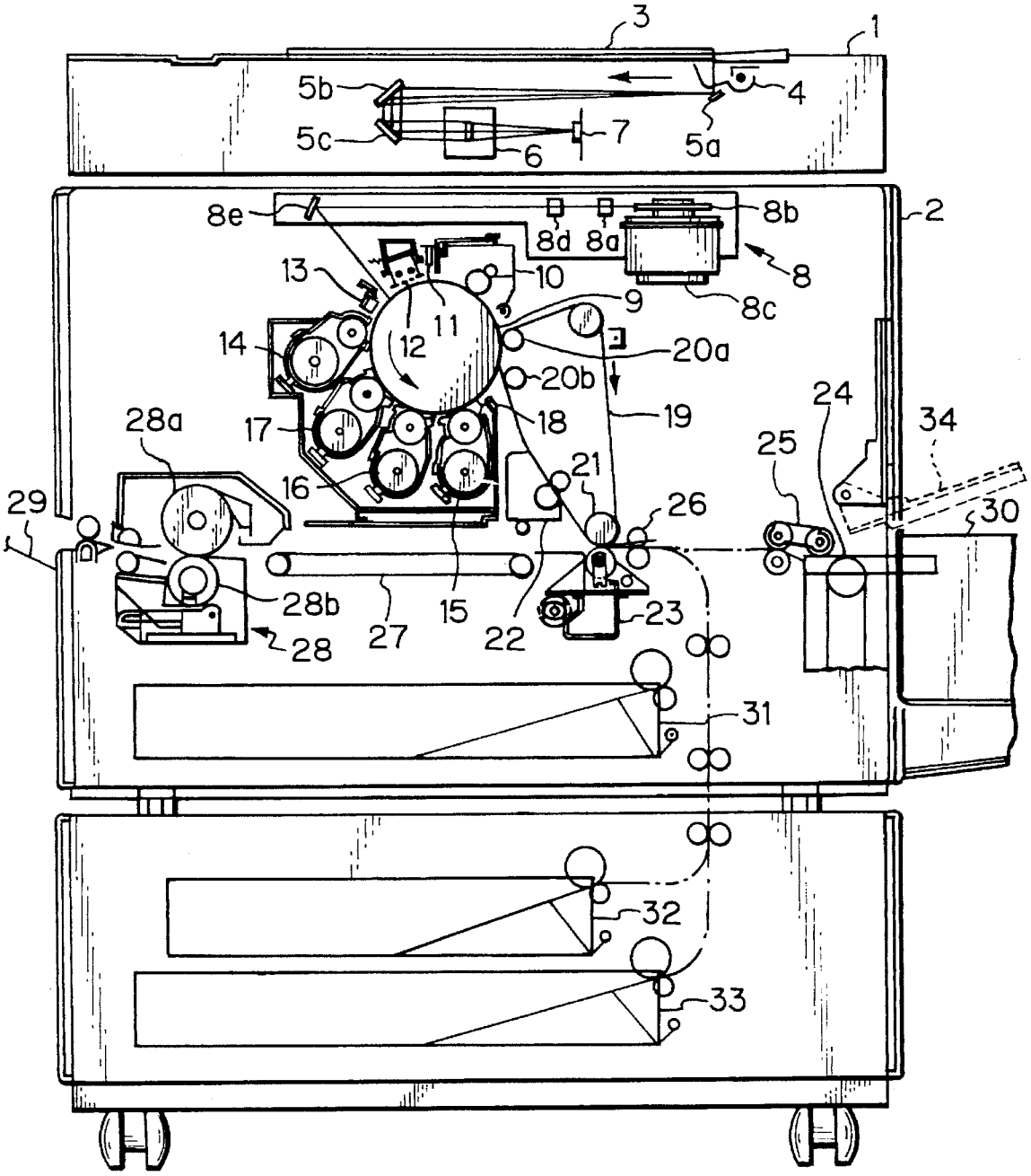
FIG. 1 is a section showing the general construction of an image forming apparatus embodying the present invention and implemented as a color copier.
Figure 2:
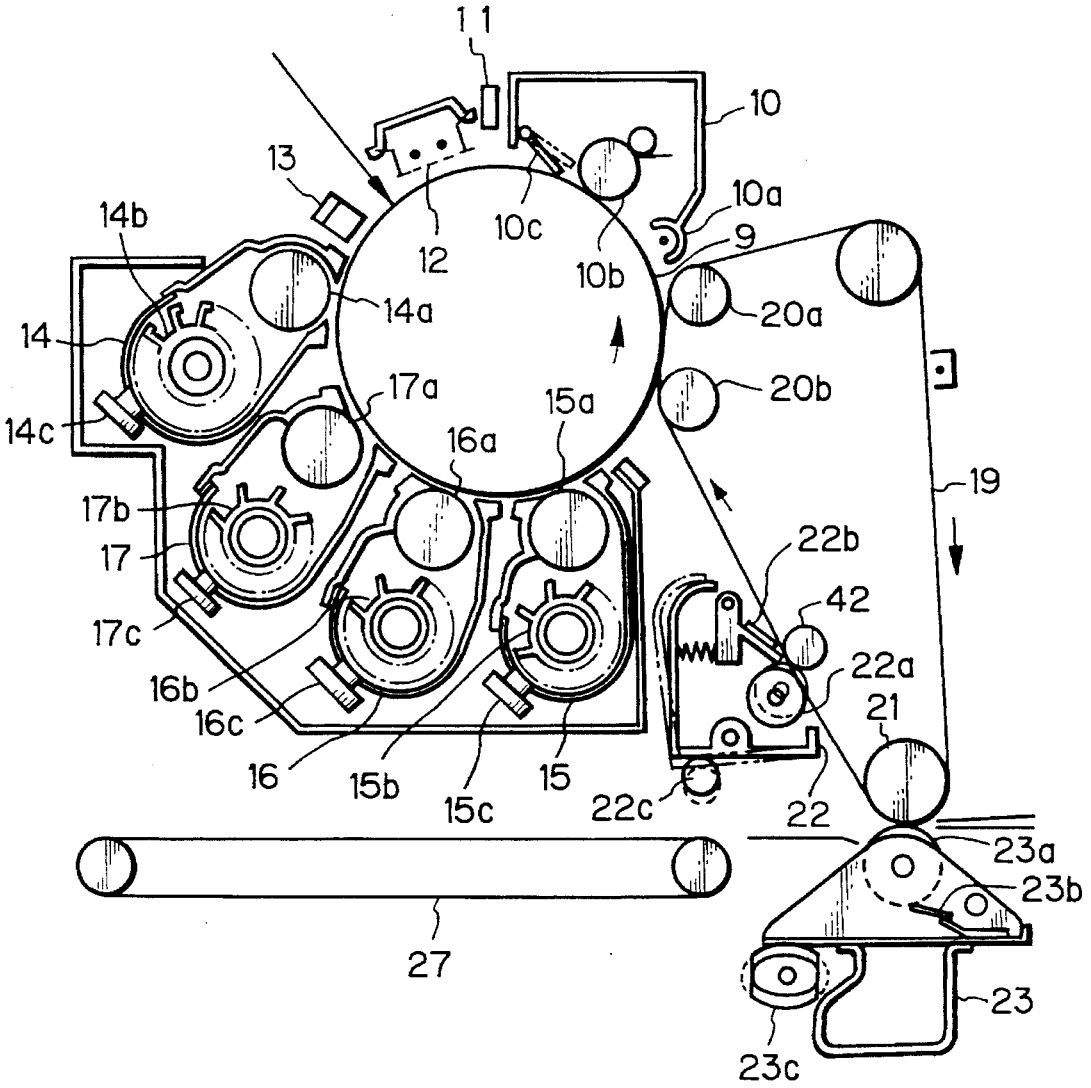
FIG. 2 is a fragmentary section showing a photoconductive drum and an intermediate image transfer belt included in the embodiment, together with members surrounding them.

Referring to FIGS. 1 and 2, an image forming apparatus embodying the present invention is shown and implemented as a color copier by way of example. As shown, the copier has a color image reading device or color scanner 1. When the color scanner 1 illuminates a document 3 with a lamp 4, the resulting imagewise reflection is incident to a color sensor 7 via mirrors 5*a*, 5*b* and 5*c* and a lens 6. The color sensor 7, therefore, reads color image data on a color basis, i.e, blue (B), green (G) and red (R) and transforms them to corresponding electric image signals. An image processing section, not shown, executes color conversion with the B, G and R image signals on the basis of their intensity levels, thereby producing black (Bk), cyan (C), magenta (M) and yellow (Y) color image data. A color image recording device or color printer 2, which will be described, sequentially forms Bk, C, M and Y toner images while superposing them one above the other. As a result, a composite tetracolor or full-color image is produced.

In the color printer 2, an optical writing unit 8 transforms the color image data from the color scanner 1 to an optical signal and scans a photoconductive drum 9 therewith, thereby electrostatically forming a latent image corresponding to the document image. The drum 9 is rotated counterclockwise, as indicated by an arrow in the figures. Arranged around the drum 9 are a drum cleaning unit (including a precleaning discharger) 10, a discharge lamp 11, a main charger 12, a potential sensor 13, a Bk developing unit 14, a C developing unit 15, an M developing unit 16, a Y developing unit 17, an optical sensor 18 responsive to a predetermined density pattern, and an intermediate image transfer belt 19. The developing units 14–17 respectively have developing sleeves 14*a*–17*a*, paddles 14*b*–17*b*, and toner concentration sensors 14*c*–17*c*. The developing sleeves 14*a*–17*a* each rotates with a developer deposited thereon and contacting the surface of the drum 9. The paddles 14*b*–17*b* each rotates to scoop up a developer while agitating it. The toner concentration sensors 14*c*–17*c* are each responsive to the toner concentration of a developer.

A copying procedure available with the copier will be described on the assumption that Bk, C, M and Y images are sequentially formed in this order by way of example.

On the start of a copying operation, the color scanner 1 starts reading Bk image data at a predetermining timing. The writing unit 8 starts forming a latent image on the drum 9 with a laser beam in response to image data generated by the color scanner 1. Let latent images derived from Bk, C, M and Y image data be respectively referred to as Bk, C, M and Y latent images hereinafter. Before the leading edge of the Bk latent image arrives at a developing position assigned to the Bk developing unit 14, the sleeve 14*a* starts rotating in order to develop the latent image from the leading edge thereof. As a result, the Bk latent image is developed by Bk toner. As soon as the trailing edge of the Bk latent image moves away from the Bk developing position, the developing unit 14 is rendered inoperative. This is completed at least before the leading edge of the next latent image, i.e., C latent image reaches the Bk developing position.

The Bk toner image is transferred from the drum 9 to the intermediate image transfer belt 19 which is driven at the same speed as the drum 9. The image transfer from the drum 9 to the belt 19 will be referred to as belt transfer hereinafter. For the belt transfer, a preselected bias voltage is applied to a transfer bias roller 20*a* while the drum 9 and belt 19 are held in contact with each other. The Bk, C, M and Y toner images are sequentially formed on the drum 9 and sequentially transferred from the drum 9 to the belt 19 one above the other. The resulting composite tetracolor image is transferred from the belt 19 to a paper at a time. A belt unit including the belt 19 will be described in detail later.

After the Bk toner image, a C toner image is formed on the drum 9. Specifically, the scanner 1 starts reading C image data at a predetermined timing with the result that a C latent image is formed on the drum 9 by a laser beam. In the C developing unit 15, the sleeve 15*a* starts rotating after the trailing edge of the Bk latent image has moved away from a developing position assigned to the unit 15, but before the leading edge of the C latent image arrives thereat. The developing unit 15 develops the C latent image by C toner. When the trailing edge of the C latent image moves away from the C developing position, the developing unit 15 is rendered inoperative. This is also completed before the leading edge of the following M latent image arrives at the C developing position. Subsequently, such a procedure is repeated with M image data and Y image data to form an M toner image and a Y toner image, respectively.

The belt unit including the belt 19 is constructed and operated as follows. The belt 19 is passed over a drive roller 21, the previously mentioned bias roller 20*a*, a ground roller 20*b*, and a plurality of driven rollers. A drive motor, not shown, causes the belt 19 to run in a manner which will be described. A belt cleaning unit 22 has a brush roller 22*a*, a rubber blade 22*b*, and a mechanism 22*c* for moving the unit 22 into and out of contact with the belt 19. After the belt transfer of the first or Bk toner image, the mechanism 22*c* holds the cleaning unit 22 spaced apart from the belt 19 during the belt transfer of the second, third and fourth toner images. Let the transfer of the composite toner image from the belt 19 to a paper be referred to as paper transfer hereinafter. A paper transfer unit 23 has a bias roller 23*a*, a roller cleaning blade 23*b*, and a mechanism 23*c* for moving the unit 23 into and out of contact with the belt 19. The bias roller 23*a* is usually spaced apart from the belt 19. When the composite toner image should be transferred from the belt 19 to a paper, the mechanism 23*c* presses the bias roller 23*a* against the belt 29 with the intermediary of the paper. At this instant, a preselected bias voltage is applied to the bias roller 23*a*.

A paper 24, FIG. 1, is fed by a pick-up roller 25 and a registration roller pair 26 to meet the leading edge of the composite image on the belt 19 at a paper transfer position where the paper transfer unit 23 is located.

Control over the drive of the belt 19 will be described hereinafter. After the first or Bk toner image has been transferred to the belt 19 up to the trailing edge thereof, the belt 19 may be driven by any one of the following three different systems. The belt 19 is driven by one of the three systems to be described or by an efficient combination thereof in relation to the copying speed.

Constant Speed Forward System

A constant speed forward system consists of the following steps.

(1) Even after the belt transfer of the Bk toner image, the belt 19 is continuously driven forward at a constant speed.

(2) The next or C toner image is formed on the drum 9 such that the leading edge thereof reaches the belt transfer position, where the drum 9 contacts the belt 19, just when the leading edge of the Bk toner image transferred to the belt 19 again arrives at the belt transfer position. As a result, the C toner image is transferred to the belt 19 in accurate register with the Bk toner image.

(3) This is repeated with the M and Y toner images so as to produce a tetracolor image on the belt 19.

(4) While the belt 19 carrying the composite image thereon is continuously driven forward, the image is transferred from the belt to the paper 24, as stated earlier.

Skip Forward System

A skip forward system is executed as follows.

(1) After the belt transfer of the Bk toner image, the belt 19 is released from the drum 9, caused to skip forward at a high speed over a predetermined distance, and then driven at the original speed. Subsequently, the belt 19 is again brought into contact with the drum 9.

(2) The next or C toner image is formed on the drum 9 such that the leading edge thereof reaches the belt transfer position just when the leading edge of the Bk toner image transferred to the belt 19 again arrives at the belt transfer position. As a result, the C toner image is transferred to the belt 19 in accurate register with the Bk toner image.

(3) This is repeated with the M and Y toner images so as to produce a tetracolor image on the belt 19.

(4) After the belt transfer of the fourth or Y toner image, the belt 19 is continuously moved forward at the same speed. Consequently, the composite color image is transferred from the belt 19 to the paper 24.

Reciprocation (Quick Return) System (1) After the belt transfer of the Bk toner image, the belt 19 is released from the drum 9, brought to a stop, and the reverse or returned at a high speed. After the leading edge of the Bk toner image on the belt 19 has passed through the belt transfer position in the reverse direction and then further moved a predetermined distance, the belt 19 is brought to a stop.

(2) When the leading edge of the C toner image on the drum 9 arrives at a predetermined position short of the belt transfer position, the belt 19 is again driven forward and brought into contact with the drum 9. The C image is also transferred from the bulk 9 to the belt 19 in accurate register with the Bk image existing on the belt 19.

(3) This is repeated with the M and Y toner images so as to produce a tetracolor toner image on the belt 19.

(4) After the belt transfer of the fourth or Y toner image, the belt 19 is moved forward at the same speed without being returned. As a result, the composite color image is transferred from the belt 19 to the paper 24.

After the composite color image has been transferred from the belt 19 to the paper 24 by any of the above-described drive systems, the paper 24 is conveyed to a fixing unit 28 by a paper transport unit 27. The fixing unit 28 has a heat roller 28*a* controlled to a predetermined temperature and a press roller 28*b*. After the toner image on the paper 24 has been fixed on the paper 24 by the heat roller 28*a* and press roller 28*b*, the paper 24 is driven out of the copier to a copy tray 29 as a full-color copy.

After the belt transfer, the drum 9 has the surface thereof cleaned by the drum cleaning unit 10 having a precleaning discharger 10*a*, a brush roller 10*b*, and a rubber blade 10*c*. Subsequently, the drum surface is uniformly discharged by the discharge lamp 11. On the other hand, the mechanism 22*c* presses the belt cleaning unit 22 against the belt 19 to clean the surface of the belt 19.

In a repeat copy mode, after the formation of the first Y image (fourth color), the operation of the color scanner 1 and the image formation on the drum 9 are repeated at a predetermined timing to form the second Bk (first color) image. Regarding the belt 19, after the paper transfer of the first composite image, the second Bk image is transferred to the area of the belt 19 which has been cleaned by the belt cleaning unit 22. This is followed by the same steps as executed with the first copy.

Paper cassettes 30, 31, 32 and 33 are each loaded with a stack of papers of particular size. When a desired paper size is entered on an operation panel, not shown, papers of the desired size are sequentially fed from one of the cassettes 30–33 toward the registration roller pair 26. The reference numeral 34 designates a manual feed tray assigned to OHP (Over Head Projector) papers, thick papers, and other special papers.

While the foregoing description has concentrated on a tetra or full-color copy, a tricolor or a bicolor copy is also achievable only if the procedure described above is repeated on the basis of the number of colors and the desired number of copies. Further, in a monocolor copy mode, one of the developing units matching the color is held operative until a desired number of copies have been produced. In this case, the belt 19 is continuously driven forward at a constant speed in contact with the drum 9, and the belt cleaning unit 22 is held in contact with the belt 19.

Figure 3:
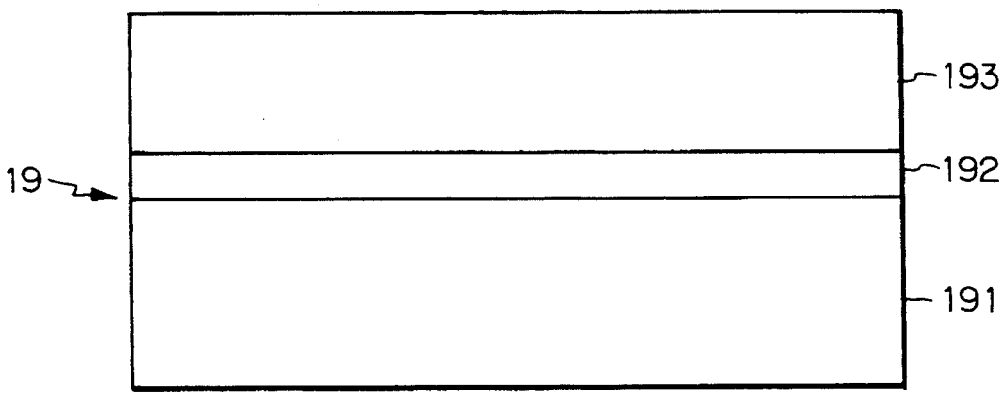
FIG. 3 is a section of the belt.

Referring to FIG. 3, the intermediate transfer belt 19 is shown in a section. As shown, the belt 19 is made up of a support or base layer 191, an adhesion layer 192, and a high resistance layer 193. The support layer 191 is formed by extrusion molding or similar technology to a thickness of 70 μm to 250 μm and made of a material having a lower specific resistance than the material of the high resistance layer 193. Therefore, the resistance of the support layer 191 is irregular by one figure. When the specific resistance of the material of the layer 191 is far lower than that of the material of the layer 193, a high bias voltage will be needed for the belt transfer, or primary transfer, and will cause a discharge to occur between the belt 19 and the adjacent members. Conversely, if the specific resistance of the layer 191 is far higher than that of the layer 193, the irregular resistance distribution of the layer 191 will effect the irregularity in the bulk resistance of the belt 19, which will be described later. The prerequisite is, therefore, that the layer 191 be made of a material having a particular specific resistance in association with the specific resistance of the layer 193.

The adhesion layer 192 is an optional thin layer and formed between the support layer 191 and the high resistance layer 193 by dipping, spraying or similar technology when the adhesion strength between the layers 19 1 and 193 is short. This layer 192 is omissible if sufficient adhesion is achievable between the layers 191 and 193. Visible color images are formed on the high resistance layer or upper layer 193. The layer 193 is about 1 μm to 50 μm thick and made of a material having a specific resistance ranging from $1\times10^{10}$ Ωcm to $1\times10^{16}$ Ωcm. The layer 193 may be formed on the support layer or lower layer 191 or the adhesion layer 192 by, for example, dipping or spraying. With such a technology, it is possible to control the thickness distribution of the layer 193 to below ±5% and, therefore, to control the resistance distribution of the layer 193 to below ±10%.

The belt 19, having such a laminate structure and the high resistance layer 193 higher in specific resistance than the support layer 191, is capable of reducing the irregularity in the resistance thereof (amounting to one figure) to about ±10%. The irregularity in the resistance of an intermediate image transfer element has been a problem awaiting a solution.

Figure 4:
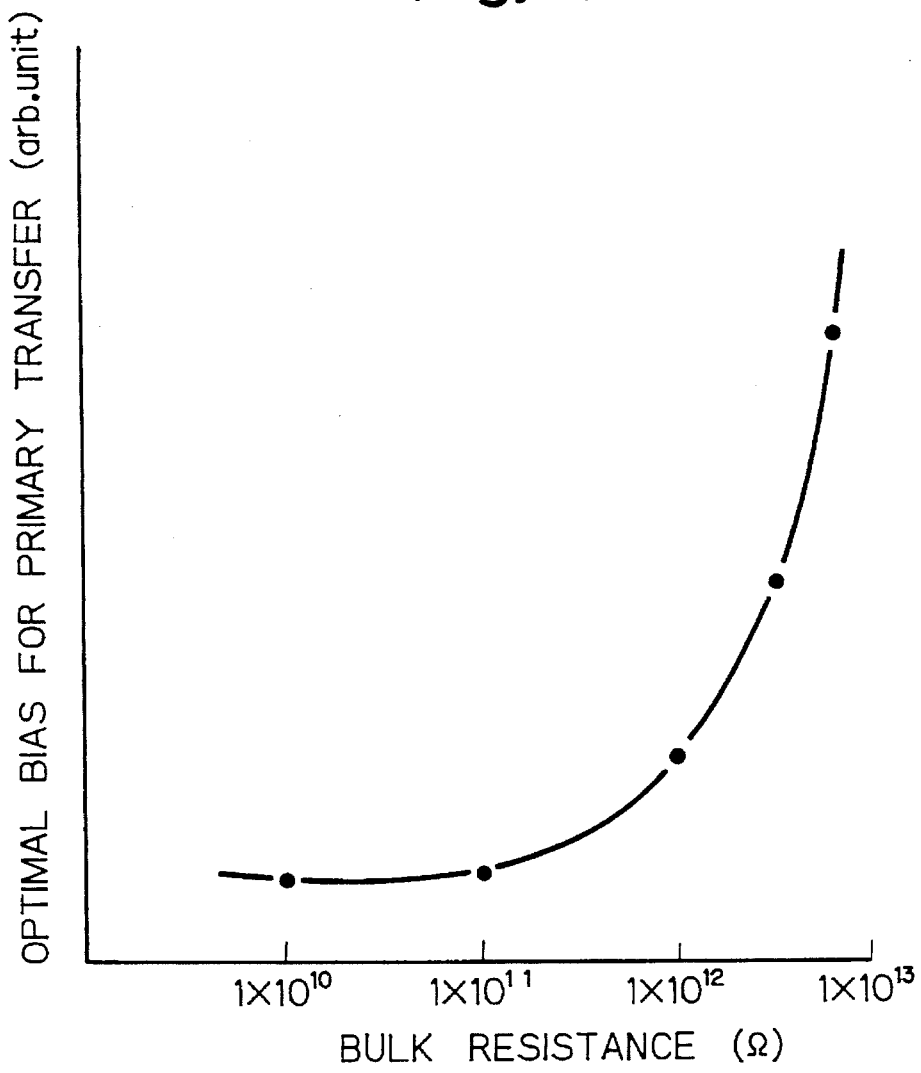
FIG. 4 is a graph indicating a relation between an optimal bias for primary image transfer and the resistance of the belt.

FIG. 4 shows a relation between the optimal bias for the primary transfer and the bulk resistance of the belt 19 as measured in the thicknesswise direction. As shown, the optimal bias for the primary transfer remains substantially constant up to the bulk resistance of about $10^{11}\Omega$, but it sharply rises when the bulk resistance approaches $10^{12}\Omega$. Assuming that the allowance of the optimal bias is constant, such a sharp rise of the bulk resistance suggests the following. So long as the bulk resistance is about $10^{11}\Omega$ or below, the transfer bias is hardly dependent on the bulk resistance. Hence, the irregularity in the inside resistance of the belt 19 does not translate into conspicuous irregularity in image transfer characteristic. However, when the belt 19 has a bulk resistance higher than 10 Ω, the irregularity in the inside resistance of the belt 19 appears as noticeable irregularity in image transfer. As a result, when the resistance inside the belt is scattered over a broad range, a belt whose bulk resistance is higher than $10^{12}\Omega$ cannot be used in practice.

On the other hand, it has been reported that toner dust, or transfer dust as generally referred to, is apt to occur more when the belt resistance is high than when it is low. It follows that if the irregularity in the inside resistance of the belt can be reduced, it is possible to use a belt having a high resistance and, therefore, to reduce transfer dust.

Why the structure of the belt 19 stated above can reduce the irregularity in the inside resistance of the belt 19 is as follows. The following description will concentrate, for the sake of the simplicity of description, on a structure having only the support layer 191 and high resistance layer 193 and the relation between the irregularity in the resistance of the layer 191 and that of the layer 193. First, assume that the support layer 191 has a bulk resistance $R_{191}$ in the thicknesswise direction, that the high resistance layer 193 has a bulk resistance $R_{193}$ in the same direction, and that a relation of $R_{193}>>R_{191}$ holds. Then, the bulk resistance $R_{bulk}$ of the belt 19 in the thicknesswise direction is expressed as:

$$R_{bulk}=R_{193}+R_{191}=R_{193}\left(1+\frac{R_{191}}{R_{193}}\right)\approx R_{193}$$

Therefore, the bulk resistance $R_{bulk}$ of the belt 19 is determined by the bulk resistance $R_{193}$ of the high resistance layer 193. It follows that the irregularity in the resistance of the belt 19 also depends on the irregularity in the bulk resistance of the layer 193. This means that the irregularity in the resistance of the belt 19 can be reduced if the irregularity in the bulk resistance of the layer 193 is reduced. Regarding the layer 193, by adopting dipping, spraying or similar technology, it is possible to reduce the resistance distribution to less ±10%, as stated earlier. Hence, when $R_{193}>>R_{191}$ hold, if the layer 193 is formed by such a technology to have a resistance of the belt 19 can be ±10%, the irregularity in the resistance of the belt 19 can be reduced to a value matching such a resistance distribution.

The bulk resistance $R_{193}$ of the layer 193 may be produced by:

$$R_{193}=\rho_{193}\times t_{193}$$

where $\rho_{193}$ and $t_{193}$ are respectively the specific resistance and the thickness of the layer 193.

Likewise, the bulk resistance R191 of the layer 191 may be expressed as:

$$R_{191}=\rho_{191}\times t_{191}$$

where $\rho_{191}$ and $t_{191}$ are respectively the specific resistance and the thickness of the layer 191.

Therefore, the relation of $R_{193}>>R_{191}$ means the following:

$$R_{193}\times t_{193}>>\rho_{191}\times t_{119} \quad (1)$$

Considering the cost and production (ease of production) of the belt 19, the thicknesses $t_{193}$ and $t_{191}$ should preferably be 1 μm to 50 μm and 70 μm to 250 μm, respectively. The above relation (1) is, therefore, rewritten as:

$$\rho_{193}>>(1_2\times10^{2})\times\rho_{191} \quad (1)'$$

Therefore, to satisfy the above relation (1)', $\rho_{193}$ should be higher than $\rho_{191}$ by two figures or more.

It will be seen from the above that when the specific resistance $\rho_{193}$ of the layer 193 is higher than the specific resistance $\rho_{191}$ of the layer 191 by, preferably, about two figures or more, the irregularity in the inside resistance of the belt 19 can be reduced to about ±10%.

Assume that the high resistance layer 193 has a specific resistance of $4.5\times10^{12}$ Ωcm to $5.5\times10^{12}$ Ωcm and a thickness of 50 μm, and that the support layer 191 has a specific resistance of $0.5\times10^{9}$ Ωcm to $50\times10^{9}$ Ωcm and a thickness of 100 μm. Then, the irregularity in the bulk resistance $R_{bulk}$ of the belt 19 is produced by:

$$R_{bulk} = 2.2505\times10^{10}\ \Omega \text{ to } 2.8\times10^{10}\ \Omega$$
$$= 2.525\pm10.9\%\times10^{10}\ \Omega$$

Such a degree of irregularity is close to the irregularity (±10%) of the high resistance layer 193.

The bulk resistance $R_{bulk}$ of the belt 19 is determined by the bulk resistance $R_{193}$ of the high resistance layer 193, as stated earlier. Hence, it is determined by the specific resistance $\rho_{193}$ and thickness $t_{193}$ of the layer 193:

$$R_{bulk}\approx\rho_{193}\times t_{193} \quad (2)$$

Should the bulk resistance $R_{bulk}$ of the belt 19 be excessively low, transfer dust would occur. Conversely, should the bulk resistance $R_{bulk}$ be excessively high, a high bias voltage would be needed for the primary transfer and result in the previously mentioned discharge. On the other hand, the thickness $t_{193}$ of the high resistance layer, 193 would reduce the life of the belt when excessively small or would increase the cost when excessively great. The thickness $t_{193}$ should preferably range from 1 μm to 50 μm. These conditions, coupled with the equation (2), indicate that the specific resistance $\rho_{193}$ of the layer 193 should optimally be:

$$\rho_{193}=1\times10^{10}\ \Omega\text{cm to } 1\times10^{16}\ \Omega\text{cm}$$

The conventional intermediate image transfer belt has the following problems (i) and (ii). Assume that the the major component of the belt is an elastomer or similar resin, and that carbon or similar filler (inorganic resistance control agent) is dispersed therein. Then, the chain structure of the filler brakes up due to aging with the result that the resistance tends to increase (problem (i)). On the other hand, when the dispersibility of the filler in the material of the belt is short, the filler coheres due to aging or the resistance decreases due to the external electric field (problem (ii)). In any case, the resistance changes due to aging. Presumably, the cohesion of the filler or the decrease of the resistance due to the external electric field occurs since the filler, which is a simple substance, exists in the form of an aggregation, as distinguished from a primary grain, i.e., the aggregation has a stable structure, and since the above-stated tendency is accelerated due to the combination of the fillter and the elastomer or similar resin in which it is dispersed or a solvent used. To sum up, the problem (i) is attributable to the fatigue of the elastomer due to aging and the dispersion of the filler acting on each other, while the problem (ii) is attributable to the dispersion of the filler itself.

With the above in view, in the illustrative embodiment, the high resistance layer 193 is made of resin in which epichlorohydrin rubber, which is one of organic resistance control agents and has a specific resistance of $1\times10^{8}$ Ωcm to $1\times10^{12}$ Ωcm, is dissolved in a predetermined amount. Since epichlorohydrin rubber and main resin in which it is dissolved are homogeneous, the former is dissolved in the latter to form a uniform network structure. This obviates the problem (ii) particular to the dispersion of carbon or similar filler in elastomer or similar resin. In addition, the predetermined amount of epichlorohydrin rubber reduces the problem (i) without effecting the mechanical property of resin.

As stated above, when the belt 19 has the high resistance layer 193 implemented by epichlorohydrin rubber and resin, it suffers from a minimum of change in resistance. This effect is obtainable when epichlorohydrin rubber is uniformly dissolved in the resin. Further, the parting ability of toner and the environmental stability, which are required of the belt 19, greatly depend on the resin which is the major component of the belt 19. Therefore, considering the solubility, parting ability and environmental stability, the resin should preferably be implemented by vinyliden polyfluoride or similar fluorine-containing resin, a copolymer of fluoroolefin and vinylether-containing olefin or similar fluorine-containing resin which is soluble to a solvent, fluorine contained rubber, etc.

Wear resistivity and cost are other characteristics of high priority required of the belt 19. The resin should preferably be implemented by acrylic resin in consideration of the solubility of epichlorohydrin rubber, wear resistivity, and cost. Use may be made of ordinary acrylic resin produced by polymerizing acrylic acid and methacrylic acid derivative. A typical example is methacrylic acid esters including 2-hydroxyethylmethacrylate (HEMA), glycidylmethacrylate (GMA), and dimethylaminomethacrylate (DM). Alternatively, use may be made of thermosetting acrylic resin in which a carboxyl group, amine group or similar side chain is introduced.

The specific resistance $\rho_{193}$ of the high resistance layer 193 optimally ranges from $1\times10^{10}$ Ωcm to $1\times10^{16}$ Ωcm, as stated previously. In practice, however, when the combination of resin and epichlorohydrin rubber is used to form the layer 193 whose specific resistance is $1\times10^{10}$ Ωcm to $1\times10^{12}$ Ωcm, the ratio of the rubber to the entire layer 193 is 50 wt % to 100 wt %. In this case, since the property of the rubber as an elastomer appears in the layer 193, problems including misregistration of colors in a multicolor mode and change in resistance due to fatigue are brought about.

The problems mentioned above are obviated when the layer 193 is made up of resin, epichlorohydrin rubber, and a small amount of carbon, for the following reason. Both epichlorohydrin rubber and carbon are usable as a resistance control agent and can replace each other. Hence, the addition of carbon allows the amount of epichlorohydrin rubber to be reduced. The decrease of resistance (bulk resistance) due to aging and attributable to the cohesion of the filler, as stated earlier, is caused by a number of filler paths extending in the thicknesswise direction of the belt and formed by cohesion. Therefore, the probability that filler paths are formed is expected to decrease as the content of the filler decreases. It follows that if the amount of carbon, or filler, is reduced, such a probability will decrease and eliminate the change in resistance due to aging.

Consequently, regarding a composition which provides the layer 193 with a relatively low optimal specific resistance ($10\times10^{10}$ Ωcm to $1\times10^{12}$ Ωcm, the object of the present invention is achievable if the upper layer (layer 193) is made up of resin, epichlorohydrin, and carbon.

The layer 193 made up of resin, epichlorohydrin rubber and a small amount of carbon, as stated above, makes it difficult for carbon to form an aggregation. However, the dispersibility of carbon is sometimes extremely low, depending on the combination of resins. In such a case, the irregularly in resistance is aggravated due to the local change in resistance while the resistance is locally changed due to aging, as will be easily understood by analogy. The inventors have found that, by substituting $SnO_2$, Sb-doped $SnO_2$ or similar metal oxide or tungsten fluoride or similar metal fluoride for carbon, i.e., by using a high resistance material made up of resin, epichlorohydrin rubber and metal oxide or metal fluoride, it is also possible to achieve the object of the present invention. The metal oxide or metal fluoride is more dispersible to resin than carbon, although it should be added in a slightly greater amount. In the ternary composition of resin, epichlorohydrin rubber and metal oxide or metal fluoride, the rubber not only reduces the required amount of metal oxide or metal fluoride, but also provides the layer 193, whose flexibility is lowered by the metal oxide or metal fluoride, with flexibility particular to an elastomer. The flexibility enhances the margin of the layer 193 against cracks and other defects.

We also found that in a system wherein the layer 193 has an enhanced margin against cracks, the object of the present invention is achievable when epichlorohydrin rubber is omitted from the ternary composition, i.e., when the high resistance material is implemented by the resin and metal oxide or metal fluoride. The absence of epichlorohydrin rubber is more desirable in respect of misregistration of colors in a multicolor mode.

Specific examples of the present invention and comparative examples will be described hereinafter. In each of the examples and comparative examples, an endless belt was made of carbon-containing polycarbonate and formed by extrusion molding. The belt was 150 μm thick and had a volume resistance of $1.5\times10^9$ Ωcm (DC 10 V; 1 minute). Substances listed in Table 1 below were respectively coated on the belts by spraying such that they were 15 μm thick when set. The resulting belts were dried and used as samples.

change ratio in a full-color copy mode using 300 OHP papers=bulk resistance due to aging/initial bulk resistance× 100), and (2) the bulk resistance distribution. Table 2 shown below lists the results of evaluation. In Table 2, the evaluation items (1) and (2) are respectively represented by "resistance change ratio (%)" and "initial resistance scattering (±%)".

TABLE 1

| | Exs. | | | | | | | | | | |
|---|---|---|---|---|---|---|---|---|---|---|---|
| | Exs. | | | | | | | | C. Exs. | | |
| Material | 1 | 2 | 3 | 4 | 5 | 6 | 7 | 8 | 1 | 2 | 3 |
| Epichlorohydrin Rubber *1 | 100 | 100 | 100 | 45 | 46 | — | — | — | — | — | — |
| Fluorin-Contained Rubber *2 | 100 | — | — | — | — | 100 | 100 | 100 | — | — | 100 |
| Acryl Resin *3 | — | 100 | — | — | — | — | — | — | — | — | — |
| Acryl Regenerated Silicone *4 | — | — | 100 | 100 | 100 | — | — | — | — | 100 | — |
| Carbon Black | — | — | — | 5 | — | — | — | — | — | 25 | — |
| Tin Oxide | — | — | — | — | 10 | 110 | 130 | — | — | — | 150 |
| Tungsten Fluoride | — | — | — | — | — | — | — | 100 | — | — | — |
| Volume Resistance of Upper Layer (Ωcm) | $2.5\times10^{13}$ | $3.2\times10^{13}$ | $5.2\times10^{13}$ | $4.5\times10^{12}$ | $1.8\times10^{12}$ | $4.1\times10^{11}$ | $6.8\times10^{10}$ | $7.9\times10^{11}$ | — | $4.3\times10^{9}$ | $1.1\times10^{9}$ |

*1: Epichlomer CG (Daiso)
*2: Lumifron LF200 (Asahi Glass)
*3: Aroset 5873-XB-50 (Nippon Shokubai)
*4: KR9706 (Shinetsu Kagaku)
*5: Printex L (Dekusa)
*6: S-1 (Mitsubishi Material)
*7: 6-tungsten fluoride (Central Glass)

The belts, or samples, prepared by Examples (Exs.) 1–8 and Comparative Examples (C. Exs.) 1–3 were evaluated as to (1) the decrease of resistance due to aging (bulk resistance

TABLE 2

| | Exs. | | | | | | | | | | |
|---|---|---|---|---|---|---|---|---|---|---|---|
| | Exs. | | | | | | | | C. Exs. | | |
| Characteristic | 1 | 2 | 3 | 4 | 5 | 6 | 7 | 8 | 1 | 2 | 3 |
| Initial Resistance | | | | | | | | | | | |
| Mean (Ω) | $3.0 \times 10^{10}$ | $4.7 \times 10^{10}$ | $7.5 \times 10^{10}$ | $6.5 \times 10^{9}$ | $2.7 \times 10^{9}$ | $6.8 \times 10^{8}$ | $1.0 \times 10^{8}$ | $1.8 \times 10^{9}$ | $2.3 \times 10^{7}$ | $2.9 \times 10^{7}$ | $1.9 \times 10^{7}$ |
| Scattering (±%) | ±102 | ±9.8 | ±100 | ±9.9 | ±9.7 | ±122 | ±150 | ±9.6 | ±181 | ±185 | ±204 |
| Resistance Change Ratio (%) | 61.3 | 86.7 | 86.0 | 42.2 | 1176 | 59.3 | 38.7 | 73.5 | 1.38 | 2.39 | 1.55 |

As Table 2 indicates, the belt of the illustrative embodiment (Examples) is far more desirable than the conventional belt (Comparative Examples) as to the irregularity in resistance and the change in resistance due to aging.

Figure 5:
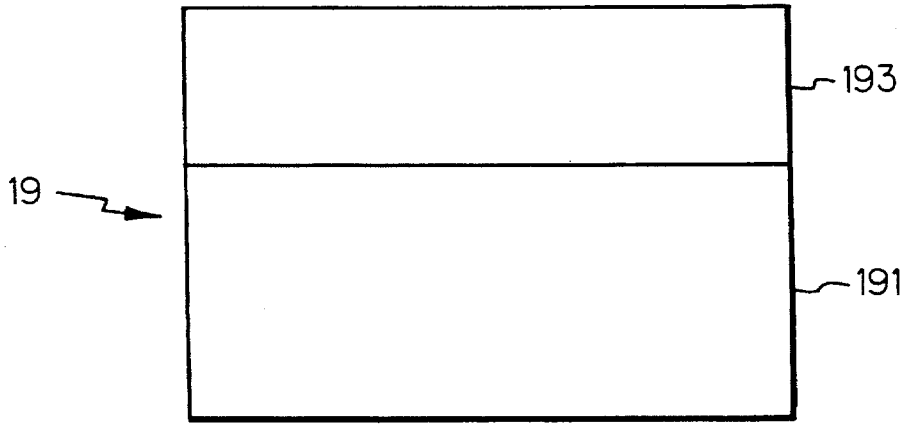
FIG. 5 is a section showing another specific configuration of the belt in accordance with the present invention.

Referring to FIG. 5, an alternative embodiment of the present invention will be described. As shown, the belt 19 is made up of the support layer 191 and high resistance layer 193. In this embodiment, the support layer 19 is 50 μm thick and consists of a polymer component and a resistance control agent dispersed therein. The high resistance control 193, on which a visible color image is to be formed, is also 50 μm thick and consists of a polymer component and a resistance control agent dispersed therein. It should be noted that the two layers 191 and 193 respectively represent a portion of a single-layer belt where the concentration of the resistance control agent is low and and a portion where it is high, as measured in the thicknesswise direction (bulk direction). That is, the belt 19 is a continuous webbing made of a polymer component, i.e., main resin in which the resistance control agent is dispersed; the concentration of the agent simply differs in the thicknesswise direction of the webbing. Specifically, the mean concentration of the agent is lower in the layer 193 than in the layer 191. Therefore, the film constituting the belt 19 does not have any interface (except for the interface between the filler and the polymer component).

In the event of image transfer using the belt 19 shown in FIG. 5, a charge opposite in polarity to toner flows from the belt 19 into the drum 9 due to the application of the transfer bias. The relation between the charge to flow into the drum 9 and the transfer dust will be discussed, assuming negative-to-positive development. Assume that the potential in the dark portion of the drum 9 is $V_D$, the current to flow into the dark portion is $i_D$, the potential in the light portion of the drum 9 is $V_L$, and the current to flow into the light portion is $i_L$. Then, when $i_D/i_L$ increases, the charge opposite in polarity to toner, i.e., to the surface of the drum 9 flows more into the dark portion than into the light portion. As a result, the potential gap between the $V_D$ and $V_L$ decreases. This means that the force of the drum 9 for retaining the toner decreases. Therefore, it will be apparent that an increase in $i_D/i_L$ aggravates the transfer dust while a decrease in $i_D/I_L$ reduces it.

Assume a parallel equivalent circuit having a path along which the current flows into the toner and the light portion of the drum 9 via the belt 19 and transfer medium, and a path along which it flows into the dark portion of the drum 9 without the intermediary of the toner. Also, in this circuit, assume that the bias voltage for image transfer is V, that the bulk resistance of the belt 19 is $R_{bulk}$, and that the electrostatic capacity of the toner is $C_t$. Then, $i_D/i_L$ is expressed as:

$$\frac{i_D}{i_L} = \frac{V + V_D}{V + V_L} \cdot \mathrm{Exp}\left(\frac{t}{R_{bulk} \cdot C_t}\right)$$

Assuming that $C_t$, $V_D$, $V_L$ and V (constants determined by the material of toner and the developing step) are constant, an increase in the bulk resistance $R_{bulk}$ of the belt 19 results in an increase in $I_d/i_L$ (required characteristic (I)).

Generally, an intermediate image transfer belt having a medium resistance has an advantage that after cleaning the belt can be restored to its electrically neutral initial state without resorting to a discharging device. For this purpose, the belt is required to release, after cleaning, a charge induced therein and opposite in polarity to toner to a ground roller before the next primary image transfer. Specifically, ε and ρ particular to the belt have to satisfy such a time constant (required characteristic (II)). A series of extended researches showed that the above required characteristics (I) and (II) can be satisfied if the concentration of the resistance control agent in the belt is lower in the surface layer portion than in the other layer portion. With such a belt, it is possible to increase the bulk resistance $B_{bulk}$ of the belt, i.e., to reduce $i_D/i_L$, thereby reducing transfer dust.

When the belt 19 of the embodiment is implemented as a belt of medium resistance, it can be restored, after cleaning, to its electrically neutral initial state without resorting to a discharging device.

In the event of the primary transfer of toner from the drum 9 to the belt 19 of the illustrative embodiment, it is preferable that the transfer current to flow from the belt 19 to the drum 9 does not have a threshold for to the transfer bias. For this purpose, a spatial charge should not exist between the support layer 191 and the high resistance layer 193.

In this embodiment, the two layers 191 and 193 are made of substantially the same resin and the same resistance control agent and substantially implemented as a single layer; the layers 191 and 193 are distinguished from each other only by the concentration of the resistance control agent in the thicknesswise direction. This kind of configuration successfully reduces the spatial charge to zero or to a minimum value. This can also be done with a belt having a support layer and a high resistance layer formed on the support layer by applying the same resin and resistance control agent as those of the support layer by spray coating or similar wet-process film forming technology. Why the spatial charge can be reduced to zero or to a minimum value is, presumably, as follows. For example, assume that the high resistance layer i s formed on the support layer by a dry-process film forming method. Theta, even if the high resistance layer is made of the same resin and resistance control agent as those of the support layer, a spatial charge exists at the interface between the two layers since the support layer suffers from atmospheric and thermal hysteresis. In contrast, in the belt 19 of the embodiment, the interface does not exist between the two layers. In addition, when the high resistance layer is implemented by the wet-process film forming process, the resin and resistance control agent constituting the layer erode the surface of the support layer.

For the reasons described above, when the belt 19 has the support layer 191 and high resistance layer 193 thereof made of the same resin and the same resistance control agent, the transfer current to flow from the belt 19 to the drum 9 is prevented from having a threshold for the transfer bias. Hence, the primary image transfer from the drum 9 to the belt 19 occurs in a desirable manner. In addition, such a belt 19 can be produced by a single extrusion molding step.

In this embodiment, the high resistance layer 193 is also made of resin in which epichlorohydrin rubber, or organic resistance control agent, having a specific resistance of $1\times20^8$ Ωcm to $1\times10^{12}$ Ωcm is dissolved in a predetermined amount. This is to avoid the change in resistance attributable to the dispersion of a filler (inorganic resistance control agent).

Epichlorohydrin rubber, playing the role of a resistance control agent, has an advantage that the resistance is sparingly dependent on the environment. Therefore, the high resistance layer 193 implemented by the resin containing epichlorohydrin rubber suffers from a minimum of change in resistance against the varying environment.

Epichlorohydrin rubber applicable to the embodiment may be a homopolymer of epichlorohydrin or a copolymer at least partly containing epichlorohydrin. The copolymer may be a copolymer of epichlorohydrin and alkylene oxide or a copolymer of epichlorohydrin, alkylene oxide, and arylglycidine ether.

By implementing the resistance control agent as nylon soluble to alcohol, it is also possible to eliminate the decrease in resistance due to the dispersion of a filler. Another advantage attainable with nylon soluble to alcohol is that it is not tacky and highly resistive to wear. Epichlorohydrin rubber, which is an elastomer, cannot be added in a great amount since the belt 19 should avoid a tacking property in order to eliminate misregistration of colors and fatigue due to aging. Nylon soluble to alcohol is free from such a limitation. Nylon soluble to alcohol may be a ternary copolymer of, for example, 6-nylon, 6,6-nylon and 6,1,0-nylon, tetra copolymer of, for example, 6-nylon, 6,6-nylon, 6,1,0-nylon and 1,2-nylon, or similar low crystallization nylon, or nylon having an alcoxyl group in the side chain.

The bulk resistance of the intermediate image transfer element should preferably range from 1×10 Ωcm to $1\times10^{14}$ Ωcm, as determined by experiments. When the element is to be provided with lower part of such a resistance range (close to $1\times10^6$ Ωcm), the proportion of epichlorohydrin rubber to the entire element increases with the result that the property of the rubber as an elastomer appears in the resulting element. This brings about misregistration of colors in a multicolor mode and changes in resistance due to fatigue. These problems are obviated when the resistance control agent is made up of epichlorohydrin rubber and an inorganic filler. This is because both epichlorohydrin rubber and inorganic filler are usable as a resistance control agent and can replace each other, so that the addition of the filler allows the amount of the rubber to be reduced. This embodiment also reduces the probability that filler paths are formed since the amount of the inorganic filler is small, thereby eliminating the change in resistance due to aging.

The inorganic filler usable as a resistance control agent may be carbon, metal oxide, e.g., tin oxide, antimony-doped tin oxide or ITO, or metal fluoride, e.g., tungsten fluoride. For epichlorohydrin rubber, use may be made of any one of the previously mentioned compounds.

Alamine CM8000 (available from Toray), which is nylon soluble to alcohol, has a specific resistance of about $1\times10^{10}$ Ωcm. When this nylon is used to form a 150 μm thick intermediate image transfer element, the bulk resistance is $1.5\times10^8$Ω. That is, even if the content of the resistance control agent is 100%, the target bulk resistance range of from $1\times10^6$ Ωto $1.5\times10^8$ Ω cannot be covered. This problem is obviated when the resistance control agent is made up of nylon soluble to alcohol and inorganic filler. This is because both nylon soluble to alcohol and inorganic filler are usable as a resistance control agent and can replace each other, so that the addition of the filler allows the amount of nylon to be reduced. In addition, since the amount of the inorganic filler is small, the probability that filler paths are formed is reduced. As a result, the change in resistance due to aging is eliminated. The inorganic filler playing the role of a resistance control agent may be implemented by any one of the examples mentioned earlier. Also, nylon soluble to alcohol may be selected from the previously mentioned specific group of compounds.

Specific examples of the present invention and a comparative example will be described hereinafter. In the examples and comparative example, endless belts were produced using compositions which are listed in Table 3 below. Each belt had a 150 μm thick support layer 191 formed by extrusion molding. The surface layer materials shown in Table 3 were respectively coated on the surfaces of the belts by spraying such that they were 10 μm thick when set. The resulting belts 19 were dried and used as samples. The volume resistances (Ωcm; DC 10 V; 1 minute) of the support layers and surface layers are shown in Table 3.

The volume resistances listed in Table 3 were measured under the following conditions:

Machine: R8340A (availble from Advantest)

Electrode weight: 4 kgf

Voltage: 500 V

Resistance reading: 10 sec value

Measuring method: JIS K6911

TABLE 3

| | Ex. 1 | | Ex. 2 | | Ex. 3 | | Ex. 4 | | Ex. 5 | | C. Ex. 1 | |
|---|---|---|---|---|---|---|---|---|---|---|---|---|
| Material | Support | Surface | Support | Surface | Support | Surface | Support | Surface | Support | Surface | Support | Surface |
| Epichlorohydrin Rubber *1 | 30 | 10 | 30 | 10 | | | 50 | 10 | | | 30 | 50 |
| Vinyl Chloride *2 | 70 | 90 | 70 | | | | 50 | 90 | | | 70 | 50 |
| Fluorin-Contained Resin *3 | | | | 90 | | | | | | | | |

TABLE 3-continued

| Material | Ex. 1 | | Ex. 2 | | Ex. 3 | | Ex. 4 | | Ex. 5 | | C. Ex. 1 | |
|---|---|---|---|---|---|---|---|---|---|---|---|---|
| | Support | Surface | Support | Surface | Support | Surface | Support | Surface | Support | Surface | Support | Surface |
| Isocianate-Based Setting Agent *4 | | | | 10 | | | | | | | | |
| 6/66/610/12 Copolymeric Nylon *5 | | | | | 50 | 30 | | | 50 | 30 | | |
| 12 Nylon *6 | | | | | 50 | | | | 50 | | | |
| Liquid Epoxy Resin *7 | | | | | | 70 | | | | 70 | | |
| Imidasol *8 | | | | | | 10 | | | | 10 | | |
| Carbon Black *9 | | | | | | | 30 | | 20 | | | |
| Volume Resistance (Ωcm) | $4\times10^{11}$ | $2\times10^{13}$ | $4\times10^{11}$ | $8\times10^{14}$ | $1\times10^{12}$ | $7\times10^{13}$ | $2\times10^{8}$ | $2\times10^{13}$ | $3\times10^{8}$ | $7\times10^{13}$ | $4\times10^{11}$ | $1\times10^{10}$ |

*1: Epichlomer (Daiso)
*2: PCH-12 (Kanegafuchi Kagaku)
*3: Lumifton (Asahi Glass)
*4: Colonate EH
*5: Alamine CM8000 (Toray)
*6: Diamide X-1874 (Daisel)
*7: Epicoat 806 (Yuka Shell)
*8: Printex L (Degusa)

The belts produced by Examples 1–5 and Comparative Example 1 were used to form images and evaluated as to transfer dust under the following conditions:

Machine: PRETER 550 (available from Ricoh)

Potential in drum dark portion: −550 V

Potential in drum light portion: −180 V

Bias for development: −400 V

Belt linear velocity: 180 mm/sec $V_B$ (bias for primary transfer):
1C 1200 V
2C 1300 V
3C 1400 V
1C 1500 V $V_p$ (bias for secondary transfer): 1300 V The results of evaluation are listed in Table 4 below.

TABLE 4

| | Ex. 1 | Ex. 2 | Ex. 3 | Ex. 4 | Ex. 5 | C. Ex. 1 |
|---|---|---|---|---|---|---|
| Transter Dust (Rank) | 4.0 | 4.5 | 4.5 | 4.5 | 4.0 | 3.0 |

As table 4 indicates, the belt of the illustrative embodiment (Examples) is far more desirable than the conventional belt (Comparative Example) in respect to transfer dust.

Another specific configuration of the belt 19 is as follows. In this embodiment, the belt 19 has a specific resistance of $1\times10^{8}$ Ωcm to $1\times10^{14}$ Ωcm and contains at least polyvinylidene fluoride (PVdF) and a polymer whose specific resistance is $1\times10^{12}$ Ωcm or below. Such a polymer, or resistance control agent, is used to control the volume of the belt 19 in place of the conventional conductive filler. This successfully eliminates the problem particular to the dispersion of a filler, i.e., the degradation of an image attributable to the change in resistance due to aging and the irregularity in the inside resistance of the belt. The fact that the polymer having the above-mentioned specific resistance is desirable as the resistance control agent for the belt 19 was found by our studies. It was also found that a polymer having a specific resistance of $1\times10^{13}$ Ωcm or above fails to effect satisfactory resistance control.

Also, when the resistance control agent of the kind stated above is dispersed in PVdF, the belt 19 additionally achieves various merits particular to fluorin-contained resins and including easy parting, stable electric characteristic against temperature and humidity, easy bending, and incombustibility. Among them, the easy parting property reduces the deposition of toner on the belt 19. In addition, the combination of PVdF and polymer enhances the homogeneity of the material and thereby obviates the irregularity resistance distribution, while reducing the change in resistance due to aging by virtue of solubility and affinity. Hence, such a combination promotes stable image formation against aging.

When the specific resistance of the belt 19 is selected to range from $1\times10^{8}$ Ωcm to $1\times10^{14}$ Ωcm, the degradation of images due to transfer dust and residual positive image can be eliminated. This was found by extended researches on defective images attributable to such causes and stems from the following:

(1) When the volume resistance ($R_{bulk}$) of the belt 19 is $1\times10^{6}$ Ω or below, images are degraded by transfer dust;

(2) On the other hand, a volume resistance ($R_{bulk}$) of $1\times10^{13}$ Ω or above causes part of a positive image to remain. In addition, a high bias voltage is needed for the primary image transfer and causes a discharge to occur, as discussed earlier.

Considering that the practical thickness of the belt 19 is about 100 μm to 500 μm, the specific resistance ($\rho_V$) of the belt 19 should optimally range from $1\times10^{8}$ Ωcm to $1\times10^{14}$ Ωcm.

Three different kinds of materials were prepared by combining 20 parts by weight (corresponding to a polymer whose specific resistance is $1\times10^{12}$ Ωcm or below) of polyether amide (Berestat 6000 available from Sanyo Kasei) with 100 parts by weight of three kinds of resin shown in Table 5 below. These materials were each kneaded and then extrusion-molded. The resulting three kinds of belts were evaluated as to the items shown in Table 5.

TABLE 5

| Resin | Crack Test | Filming Test |
|---|---|---|
| PVdF *1 | no crack | 0.01 |
| Polycarbonate *2 | crack at both ends | 0.09 |
| Acrylonitryl-Butadien-Styrene Copolymer *3 | broken after 8,000 revolutions | 0.14 |

*1: Kainer (Penwalt)
*2: Panlite 1300 (Teijin)
*3: Toyolack (Toray)

(1) Crack test: The belts were each mounted on an external idling machine and then evaluated at to cracking after 100,000 revolutions. Only the material containing PVdF and predetermined polymer was free from cracks, as shown in Table 5.

(2) Filming test: The belts were each mounted on Preter 550 (full-color copier available from Ricoh), operated to produce 10,000 copies, and then had the surface thereof blown by air. Toner left on the belt was transferred to a tape and had the density thereof measured by a Mcbeth densitometer. Only the material containing PVdF showed a value of less than 0.05, which is desirable, as shown in Table 5.

It will be seen from the above that the material containing PVdF and predetermined polymer is desirable.

Preferably, the polymer whose specific resistance is $1\times10^{12}$ Ωcm or below should include at least a polyether unit. Such a polymer is inherently low in resistance and, therefore, desirable as a resistance control agent. In addition, since this kind of polymer is highly soluble to PVdF, the combination of such two polymers is preferable. Specifically, by introducing a polyether unit in a polymer, it is possible to lower the resistance and enhance stability against the varying environment. Moreover, the polyether unit eliminates an occurrence that the solubility of the polymer to PVdF is short and aggravates the irregularity in specific resistance while degrading the belt, or film, due to voids. Examples of the polymer containing a polyether unit are polyethylene oxide, polyetheresteramide, epichlorohydrin rubber, and polyetheramideimide. Preferably, 50 parts to 100 parts by weight of such a polymer should be contained with respect to 100 parts by weight of PVdF. The polymer prevents, if smaller than 5 parts by weight, the specific resistance from lowering to a sufficient degree or degrades, if greater than 100 parts by weight, the characteristic particular to PVdF, e.g., parting ability, electric stability against temperature and humidity, bending ability, and incombustibility.

To knead PVdF and polyether compound, a conventional resin kneading method may be adopted which uses two rollers, kneader, Banbary mixer or the like.

Different kinds of materials were prepared by combining PVdF with different kinds of resistance control agents. These materials were each kneaded and then extrusion-molded to form 150 μm thick belts. The resulting three kinds of belts were evaluated as to items shown in Table 6.

TABLE 6

| No. | Control Agent | Agent Amount *1 | Agent Specific Resistance (Ωcm) | Belt Specific Resistance (Ωcm) | Change in Resistance (Order) | Irregularity in Resistance (Order) | Toner Contact |
|---|---|---|---|---|---|---|---|
| 1 | Carbon Black *2 | 10 | — | $2\times10^{10}$ | 2.9 | 2.5 | no toner |
| 2 | Polyetherester *4 | 30 | $8\times10^{12}$ | $4\times10^{14}$ | 1.0 | 0.5 | no toner |
| 3 | Polyetheresteramide *4 | 20 | $8\times10^{10}$ | $3\times10^{12}$ | 0.6 | 0.6 | no toner |
| 4 | Epichlorohydrin Rubber *6 | 20 | $2\times10^{8}$ | $3\times10^{11}$ | 0.5 | 0.5 | no toner |

*1: For 100 parts by eight of PVdF (KP Polymer 850 available from Kureha Kagaku)
*2: Ketchen Black (Lion Agso)
*3: Siastat LS (Sun Chemical) as [(3-lauramidepropyl) trimethyl ammonium methyl sulphate]
*4: Hytrel (Toray DuPont)
*5: Pepasox (Toray)
*6: Epichlomer (Daiso)

(1) Irregularity in specific resistance: Specific resistance was measured at three points in the longitudinal direction (opposite ends and center) and at four points in the circumferential direction, i.e., twelve points in total. Irregularities in specific resistance were produce by:

$$\text{irregularity}=\log(R\text{max})-\log(R\text{min})$$

(2) Change in specific resistance due to aging: DC 500 V was continuously applied in the thicknesswise direction of each belt so as to determine a difference in specific resistance between the front and the rear by:

$$\text{Change}=|\log(R\text{max})-\log(R\text{min})|$$

(3) Toner contact test: The belts were brought into contact with toner consisting of 100 parts by weight of epoxy resin, 3 parts by weight of copper phthalocyanine, 4 parts by weight of salycilate metal salt and 0.8 part by weight of silica (applied to the outer periphery), left for a week, and then had their surfaces blown by air in order to observe toner deposition.

In Table 6, No. 1 represents a conventional material not containing a polymer in a resistance control agent; the irregularity in specific resistance (desirably 1.5 or below) is greater than 1.5 and not feasible for an intermediate image transfer belt. Although No. 2 contains a polymer, the resistance of the belt is $4\times10^{14}$ Ωcm which is greater than the target range of from $1\times10^{8}$ Ωcm to $1\times10^{14}$ Ωcm. Nos. 3 and 4 meet the requirements of the present invention as to all the evaluation items.

Comparative examples not containing a polyether unit in the polymer, whose specific resistance is $1\times10^{12}$ Ωcm or below, are shown in Table 7 below.

TABLE 7

| Control Agent | Tetraammonium Group-Containing Polymer *1 |
|---|---|
| Agent Amount | 30 parts by weight *2 |
| Agent Resistance | $3 \times 10^{8}$ Ω.cm |
| Belt Resistance | $1 \times 10^{11}$ Ω.cm |
| Specific Resistance Scattering | 1.7 order |
| Belt Appearance *3 | voids |

*1: Leorex AS170 (Daiichi Kogyo Seiyaku)
*2: For 100 parts by weight of PVdF
*3: By eye As Table 7 indicates, when the above-mentioned polymer does not contain a polyether unit, voids appear in the belt while the irregularity in specific resistance increases, due to the short solubility to PVdF.

While the embodiments have been shown and described as using the intermediate image transfer belt 19, the materials and structure described in relation to the belt 19 are also applicable to an intermediate image transfer element in the form of a drum. The copier shown in FIG. 1 has secondary image transferring means implemented by a bias roller. The bias roller may be replaced with a brush, blade or similar contact electrode or even with a corona charger or similar noncontact electrode. The polarity of the bias roller or similar secondary image transferring means is not limited to the polarity stated in relation to FIG. 1, but it may be suitably selected in matching relation to the image forming process and the polarity of the photoconductive element. In addition, the primary image transferring means shown in FIG. 1 may be positioned just below the nip between the belt and the drum, if desired.

In summary, it will be seen that the present invention achieves various unprecedented advantages, as enumerated below.

(1) Since the irregularity in the resistance of an intermediate image transfer element is reduced, uniform images are insured.

(2) Since the image transfer element is provided with an adequate bulk resistance, it is free from transfer dust, discharge, and other side effects.

(3) The image transfer element is free from changes in resistance due to aging, compared to an element whose major component is an elastomer. Hence, the element insures a uniform image while eliminating defective images (blurring or the like).

(4) Epichlorohydrin rubber can be uniformly dissolved in a polymer. This enhances mutual solubility, parting of toner, stability against the varying environment, wear resistivity, cost, etc.

(5) Since the amount of addition of epichlorohydrin rubber is reduced, there can be obviated an occurrence that the property of the rubber as an elastomer appears in the upper layer of the image transfer element and thereby brings about misregistration of colors in a multicolor mode and changes in resistance due to fatigue. In addition, changes in resistance due to aging, which has been a problem awaiting a solution, is obviated.

(6) A resistance control layer can be desirably dispersed in a polymer, compared to carbon. This prevents the irregularity in resistance from increasing due to local changes in resistance and eliminates local changes in resistance due to aging.

(7) In the image transfer element, the mean concentration of the resistance control agent is lower in a surface layer portion than in the other layer portion. Hence, the element has a great bulk resistance and thereby reduces a ratio of $i_D/i_L$. This successfully reduces transfer dust which would lead to defective images.

(8) When such an image transfer element has a medium resistance, it can be restored to an electrically neutral initial state after cleaning without resorting to a discharging device.

(9) The spatial charge at the interface between a support layer and a coating layer can be reduced to zero or to a minimum value. Hence, a current to flow from the image transfer element into an image carrier is prevented from having a threshold for a transfer bias. This insures desirable primary transfer of toner from the image carrier to the element.

(10) There is eliminated changes in resistance due to aging and attributable to the cohesion of a filler dispersed in the image transfer element. This prevents the quality and uniformity of images from being lowered and eliminates defective images (blurring or the like).

(11) Since the non-stacky property and wear resistivity of the image transfer element are enhanced, misregistration of colors and fatigue due to aging are obviated.

(12) It is possible to reduce the amount of nylon soluble to alcohol and, therefore, to allow the image transfer element to cover the lower limit range of bulk resistance.

(13) Since the amount of an inorganic filter is small, changes in resistance due to aging and other problems are eliminated.

(14) The specific resistance of the image transfer element is prevented from changing due to aging. This, coupled with the fact that the irregularity in specific resistance is reduced, prevents the image quality from being lowered. In addition, since the element contains PVdF, it is free from toner filming on the surface thereof and cracking.

(15) With conventional resistance control schemes relying on a surface active agent, it is possible to achieve the object with a small amount of agent. However, such schemes adversely effect members contacting the surface of the image transfer element, e.g., toner and image carrier, or photoconductive element, due to the bleed to the surface of the image transfer element. The present invention eliminates this problem by using a polymer.

(16) Since the specific resistance lies in a range of from $1\times10^{8}$ Ωcm to $1\times10^{14}$ Ωcm, there can be obviated transfer dust, residual positive image, and discharge attributed to a high voltage which would invite defective images.

(17) A polymer containing a polyether unit is desirable for resistance control and is highly soluble to PVdF. With such a polymer, it is possible to lower the resistance of the image transfer element and enhance stability against the varying environment. A polymer lacking a polyether unit is not sufficiently soluble to PVdF and, therefore, aggravates the irregularity in specific resistance, resulting in voids in the belt.

Various modifications will become possible for those skilled in the art after receiving the teachings of the present disclosure without departing from the scope thereof.

What is claimed is:

1. A movable endless intermediate image transfer element for an image forming apparatus and for transferring a visible image, transferred thereto from an image carrier by primary transfer, to a transfer medium by secondary transfer, said element comprising:

an upper layer to which the visible image is to be transferred; and a lower layer positioned below said upper layer;

wherein said upper layer having a higher specific resistance than said lower layer and wherein said upper layer is made of at least a polymer component and epichlorohydrin rubber.

2. An intermediate image transfer element as claimed in claim 1, wherein the polymer component comprises a fluorine-based polymer or an acrylic polymer.

3. A movable endless intermediate image transfer element for an image forming apparatus for transferring a visible image, transferred thereto from an image carrier by primary transfer, to a transfer medium by secondary transfer, said element comprising:

an upper layer to which the visible image is to be transferred; and a lower layer positioned below said upper layer;

wherein said upper layer has a higher specific resistance than said lower layer and wherein said upper layer is made of at least a polymer component, epichlorohydrin rubber, and a resistance control agent, said resistance control agent comprising carbon.

4. A movable endless intermediate image transfer element for an image forming apparatus for transferring a visible image, transferred thereto from an image carrier by primary transfer, to a transfer medium by secondary transfer, said element comprising:

an upper layer to which the visible image is to be transferred; and a lower layer positioned below said upper layer;

wherein said upper layer has a higher specific resistance than said lower layer and wherein said upper layer is made of at least a polymer component, epichlorohydrin rubber, and a resistance control agent, said resistance control agent comprising a metal oxide or a metal fluoride.

5. A movable endless intermediate image transfer element for an image forming apparatus and for transferring a visible image, transferred thereto from an image carrier by primary transfer, to a transfer medium by secondary transfer, wherein said intermediate image transfer element comprises a plurality of layers each consisting of a polymer component and a resistance control agent, said resistance control agent dispersed in said polymer component having a lower mean concentration in a surface layer than in another layer.

6. An intermediate image transfer element as claimed in claim 5, wherein said plurality of layers comprise a support layer in which the resistance control agent is dispersed in the polymer component, and a coating layer formed on said support layer by applying a liquid in which a same polymer component and a same resistance control agent as said support layer are dispersed and drying said liquid.

7. An intermediate image transfer element as claimed in claim 6, wherein the resistance control agent comprises epichlorohydrin rubber.

8. An intermediate image transfer element as claimed in claim 6, wherein said resistance control agent comprises nylon soluble to alcohol.

9. An intermediate image transfer element as claimed in claim 6, wherein the resistance control agent comprises epichlorohydrin rubber and an inorganic filler.

10. An intermediate image transfer element as claimed in claimed 6, wherein the resistance control agent comprises nylon soluble to alcohol and an inorganic filler.

11. An image forming apparatus comprising:

an image carrier for forming a visible image thereon; and a movable endless intermediate image transfer element for transferring the visible image, transferred thereto from said image carrier by primary transfer, to a transfer medium by secondary transfer;

said intermediate image transfer element comprising a plurality of layers each consisting of a polymer component and a resistance control agent, said resistance control agent dispersed in said polymer component having a lower mean concentration in a surface layer, to which the visible image is to be transferred, than in another layer.

12. A movable endless intermediate image transfer element for an image forming apparatus and for transferring a visible image, transferred thereto from an image carrier by primary transfer, to a transfer medium by secondary transfer, wherein said element has a specific resistance of $1\times10^{8}$ Ωcm to $1\times10^{14}$ Ωcm and contains at least polyvinylidene fluoride and a polymer which has a specific resistance of $1\times10^{12}$ Ωcm or below and wherein the polymer contains at least a polyether unit.

13. An image forming apparatus for forming a visible image on an image carrier, transferring said visible image to a movable endless intermediate image transfer element by primary transfer, and then transferring said visible image to a transfer medium by secondary image transfer, wherein said intermediate image transfer medium has a specific resistance of $1\times10^{8}$ Ωcm to $1\times10^{14}$ Ωcm and contains at least polyvinylidene fluoride and a polymer which has a specific resistance of $1\times10^{12}$ Ωcm or below, and wherein the polymer contains at least a polyether unit.

14. An intermediate image transfer system for use with an image forming apparatus for transferring a visible image, transferred thereto from an image carrier, by primary transfer, to a transfer medium by secondary transfer, said system comprising:

a group of rollers including at least a transfer bias roller, a ground roller and a drive roller;

a movable endless intermediate image transfer element containing the image carrier between said transfer bias roller and said ground roller and being passed over said group of rollers, said element comprising an upper layer to which the visible image is to be transferred and a lower layer positioned below said upper layer, said upper layer having a higher specific resistance than said lower layer by more than approximately two figures; and biasing means for applying a bias voltage of about 1,000 to 1,500 volts to said transfer bias roller, wherein said primary transfer is performed by a voltage difference between said transfer bias roller and said ground roller.

15. An intermediate image transfer system as claimed in claim 14, wherein said upper layer has a specific resistance of $1\times10^{10}$ Ωcm to $1\times10^{16}$ Ωcm.

16. An intermediate image transfer system as claimed in claim 14, wherein said biasing means comprises means for applying a bias voltage of from about 1,200 to 1,500 volts to said bias roller.

17. A method for transferring a visible image from an image carrier to an endless intermediate transfer element comprising a first layer having a first specific resistance and a second layer having a second specific resistance, said first layer opposing said second layer, said first specific resistance being greater than said second specific resistance by at least two orders of magnitude, comprising the steps of:

passing the endless intermediate image transfer element between a bias roller that opposes the image carrier and the image carrier;

passing the endless intermediate image transfer element between a ground roller that is grounded and that opposes the image carrier and the image carrier;

applying a bias voltage of between about 1,000 and 1,500 volts to said transfer bias roller;

whereby a voltage difference between said transfer bias roller and said ground roller provides primary transfer of an image recorded on said image carrier to said endless intermediate transfer element.

18. The method of claim 17, wherein said bias voltage is from about 1,200 to 1,500 volts.

19. The method of claim 17, wherein said first layer comprises a polymer component and epichlorohydrin rubber.

20. The method of claim 19, wherein said polymer component comprises a fluorine-based polymer or an acrylic polymer.

* * * * *